US005216449A

United States Patent [19]

English

[11] Patent Number: 5,216,449

[45] Date of Patent: Jun. 1, 1993

[54] ROUNDED CAPILLARY VENT SYSTEM FOR INK-JET PRINTERS

[75] Inventor: Kris M. English, Vancouver, Wash.

[73] Assignee: Hewlett-Packard Company, Palo Alto, Calif.

[21] Appl. No.: 737,944

[22] Filed: Jul. 29, 1991

[51] Int. Cl.[5] ..... B41J 2/165

[52] U.S. Cl. ..... 346/140 R

[58] Field of Search ..... 346/140 R, 75

[56] References Cited

U.S. PATENT DOCUMENTS

| | | | |
|---|---|---|---|
| 4,437,105 | 3/1984 | Mrazek et al. | 346/140 R |
| 4,511,906 | 4/1985 | Hara | 346/140 R |
| 4,589,000 | 5/1986 | Koto et al. | 346/140 R |
| 4,684,963 | 8/1987 | Naka | 346/140 R |
| 4,853,717 | 8/1989 | Harmon et al. | 346/140 R |
| 5,027,134 | 6/1991 | Harmon et al. | 346/140 R |

FOREIGN PATENT DOCUMENTS 61-24457 2/1986 Japan .

*Primary Examiner*—Benjamin R. Fuller
*Assistant Examiner*—N. Le

[57] ABSTRACT

A rounded capillary vent system for ink-jet printers in which an ethylene propylene diene monomer (EPDM) element having a basin formed on a substantially planar surface is mounted on the under side of a nylon sled. An EPDM cap for a printhead is mounted on the top surface of the sled. A vent is defined between a semicircular groove formed on the under side of the nylon cover and the EPDM planar surface. The vent extends from the edge of the cover to a location over the basin. Ink from the printhead collects in the basin and at least some of the collected ink drains through the vent. Ink in the vent collects in the corners formed at the juncture of the EPDM material and polycarbonate cover. The capillary space between the EPDM material and the nylon cover draws the collected ink thereinto thus preventing vent clogging.

7 Claims, 4 Drawing Sheets

ROUNDED CAPILLARY VENT SYSTEM FOR INK-JET PRINTERS

BACKGROUND OF THE INVENTION

1. Field of the Invention

The present invention relates to ink-jet printers and more particularly to a cap system in such a printer which includes a rounded vent in which capillary action acts to reduce the potential for vent clogging.

2. Description of the Related Art

An ink-jet printer includes a replaceable printing cartridge having a printhead formed thereon. The cartridge includes a reservoir of ink which is fired through nozzles in the printhead onto a printing medium such as paper. The structure and operation of such printing cartridges is well known to those skilled in the art.

There are two primary constraints for maintaining ink-jet printheads when they are not in use. First, a sealed environment must be provided for the nozzles to prevent them from drying. Secondly, pressure variations between the sealed environment and the ambient pressure must be minimized. A relative pressure decrease in the sealed environment can cause priming of the nozzles, which in a three chamber pin may result in color mixing. A pressure increase can deprime the nozzles which can render them inoperable.

Prior ink-jet printers include a service station at one end of the travel path of a printing carriage upon which the printing cartridge is mounted. The service station includes a wiper for wiping the printhead to remove contaminants, dried ink and the like from the printhead surface containing the nozzle openings. Also provided is a cap which covers the printhead to prevent the ink in the nozzles from drying. The printer may be programmed to fire ink from the nozzles into the cap to create ink vapor within the cap to reduce drying of ink in the printhead nozzles. Such firing also clears the nozzles of any viscous ink.

Prior art printhead caps for ink-jet printers include vents to prevent a pressure differential across the nozzles. In an unvented cap a pressure spike may occur as the cap moves into and out of sealing engagement with the printhead. This reduces the magnitude of the spike, but also allows vapor to diffuse from the cap thereby increasing ink drying in the nozzles.

Ink drying in the nozzles is proportional to the rate of vapor diffusion from the cap. The rate of vapor diffusion is proportional to the cross-sectional area over which diffusion can occur divided by the length of the diffusion path. In order to minimize vapor diffusion it is therefore desirable to minimize the cross-sectional area of the vent while maximizing its length.

In addition to equalizing pressure, prior art vents also serve as a flow path to drain ink which collects in the cap therefrom. Prior art vents can clog with ink and thus cause undesirable pressure differentials across the nozzles. On the other hand, when the vent is made sufficiently large to prevent clogging, the vent is not a sufficiently effective vapor barrier to prevent drying of the ink in the printhead nozzles.

One prior art cap vent is disclosed in U.S. Pat. No. 5,027,134 issued Jun. 25, 1991 and assigned to the assignee of the present application. The disclosed vent has a square cross section and includes a space between the top surface of the vent and each sidewall. The ostensible purpose of the space is to wick ink from the vent by capillary action. This vent is disadvantageous for several reasons. Ink tends to collect in the lower corners of the vent where there is no space into which the ink can drain. Because the space is at the upper level of the vent, it has to fill with ink before the ink can flow into the space. This leads to clogging of the vent with ink. This vent is also very short, to reduce clogging, which renders it less effective as a vapor barrier than if a longer vent could be used.

It would be desirable to provide a cap system for an ink-jet printer which functioned as a highly effective vapor diffusion barrier without vent clogging.

SUMMARY OF THE INVENTION

The present invention comprises a cap system for an ink-jet printhead which includes a printhead cap. A substantially horizontal, elongate vent has a first end in communication with the interior of said cap and a second end in communication with the cap exterior. A capillary space extends laterally from a lower portion of the vent. In another aspect of the invention, the vent has a substantially semicircular cross section.

The present invention prevents drying of ink in the printhead nozzles by providing a highly effective vapor diffusion barrier and further prevents clogging of a printhead-cap vent. The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
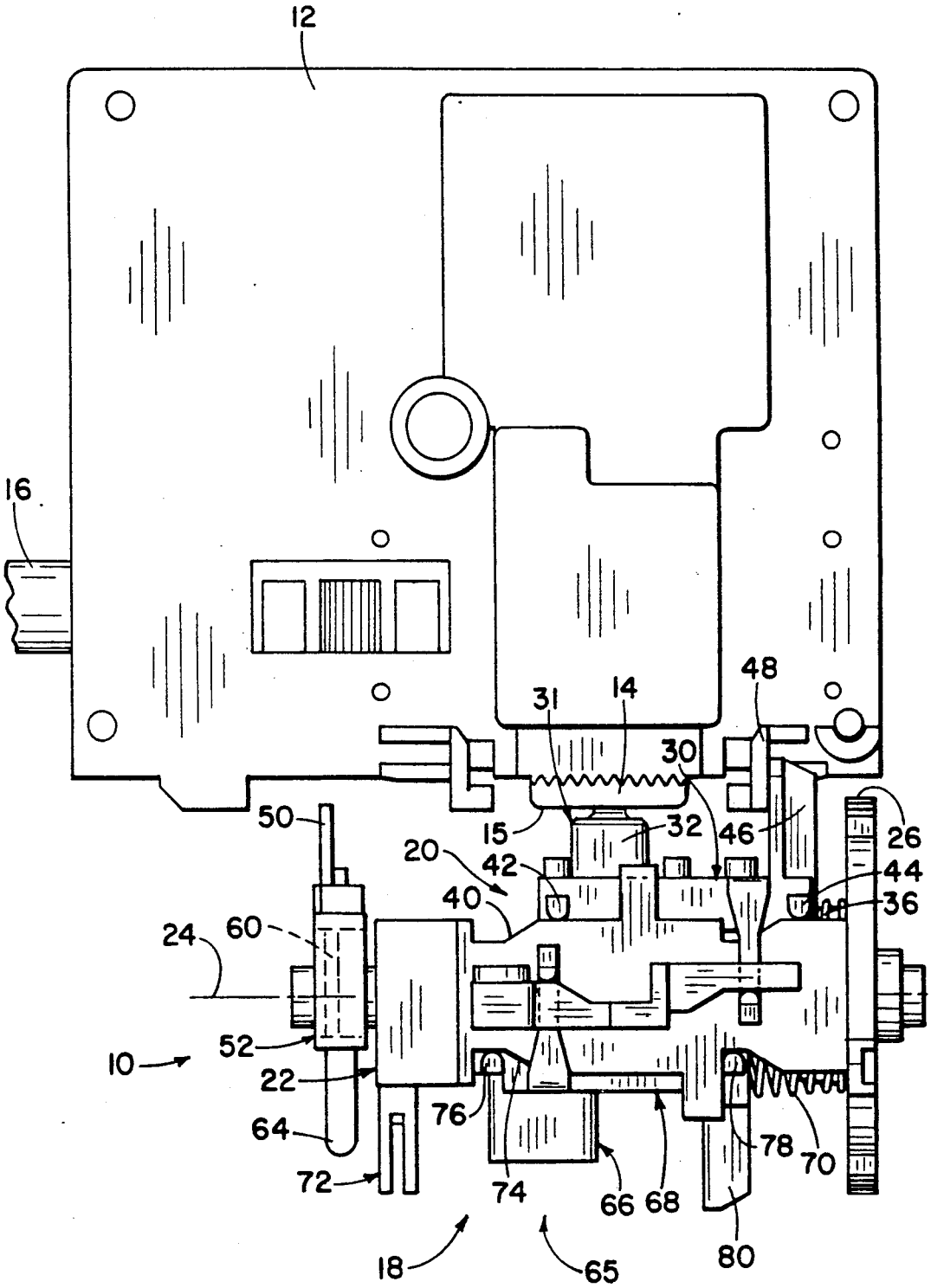
FIG. 1 is a partial front elevational view of an ink-jet printer illustrating an ink-jet printhead and a cap system constructed in accordance with the present invention.
Figure 2:
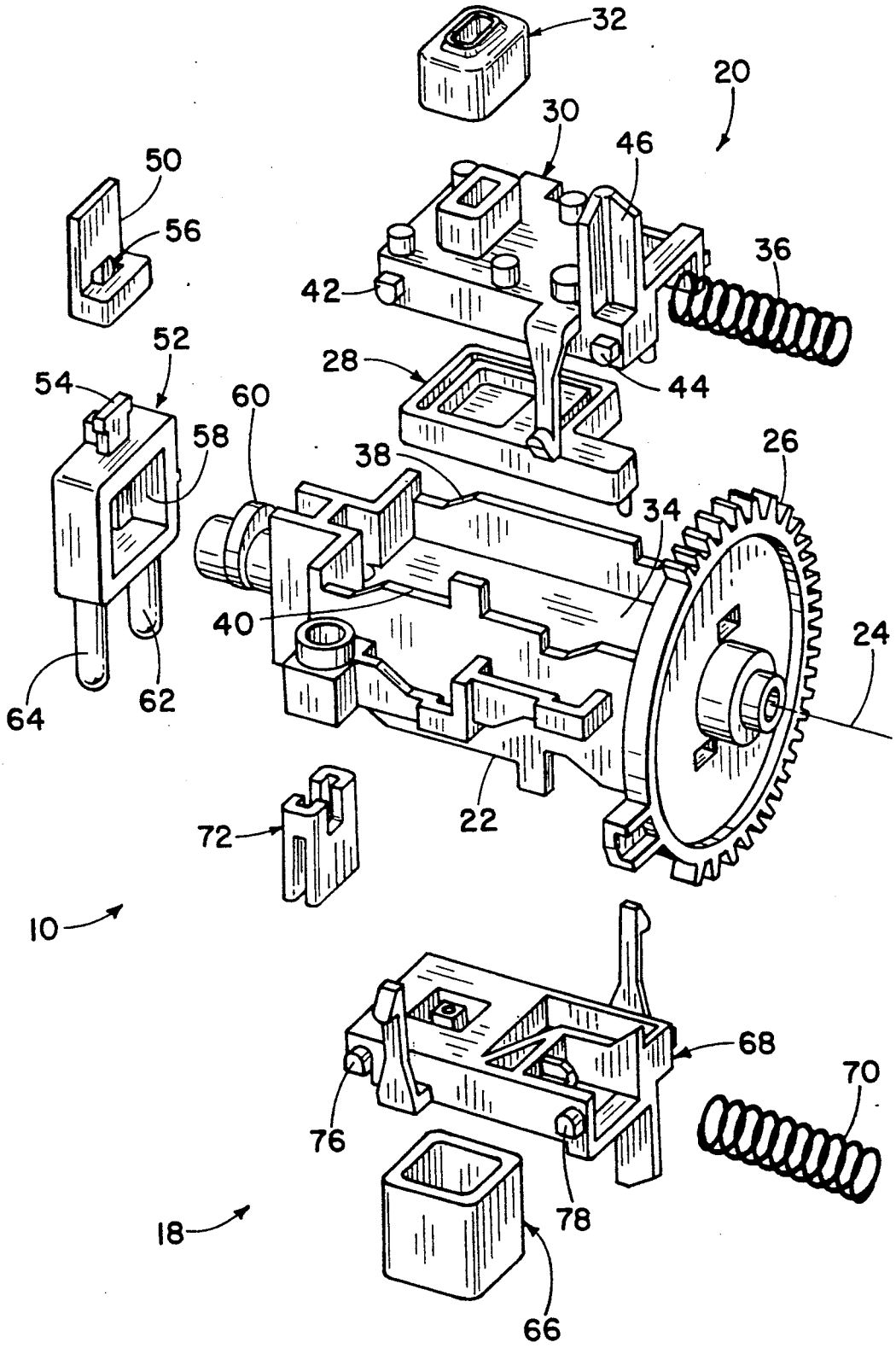
FIG. 2 is an exploded perspective view of both the black cartridge cap system and the color cartridge cap system of FIG. 1.
Figure 3:
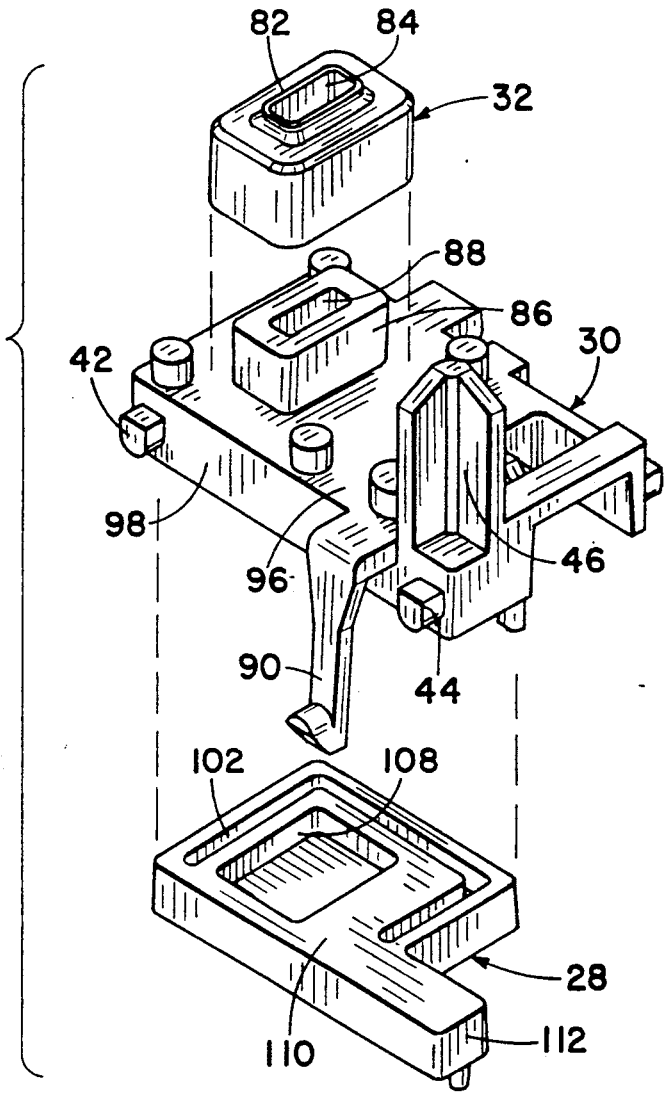
FIG. 3 is an enlarged, exploded perspective view of the black cartridge cap of FIG. 2.
Figure 4:
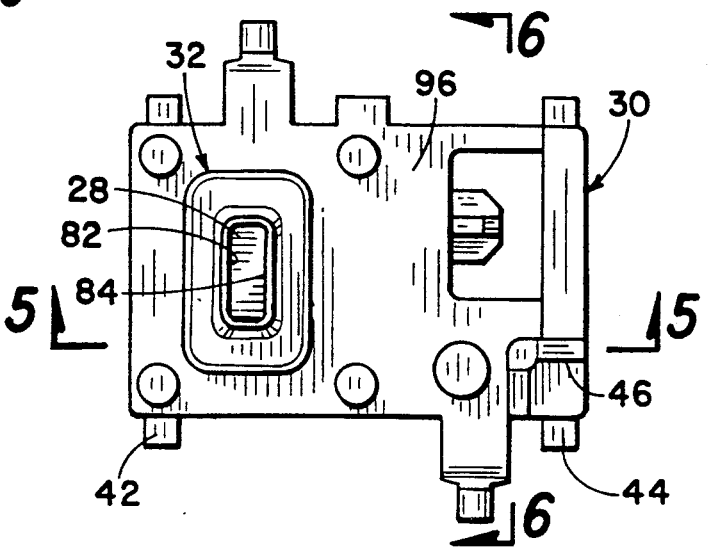
FIG. 4 is a top plan view of the black cartridge cap in assembled condition.

Indicated generally at 10 in FIGS. 1 and 2 is a service station for both black cartridge and color cartridge printheads constructed in accordance with the present invention. Service station 10 is incorporated into an ink-jet printer into which either a color cartridge or black cartridge may be loaded for color or black-ink printing. The printer includes a carriage 12 which is shown in the view of FIG. 1 having a black cartridge 14 (shown partially broken away) mounted thereon. Cartridge 14 includes a printhead 15 having nozzles (not shown) formed therein for firing ink in the cartridge therefrom. Carriage 12 is bidirectionally moveable along a guide rod 16 which substantially spans the width of the printer.

The carriage is shown in its rightmost position, as viewed in FIG. 1, which places cartridge 14 in service station 10. Carriage 12 moves to the service station when the printer is not printing or when the printhead needs servicing. On other printers the service station may be located at the leftmost side of the printer.

Although not shown for clarity, the printer includes structure for guiding paper through the printer so that the paper surface is positioned immediately beneath printhead 15 when carriage 12 moves leftwardly from service station 10.

Service station 10 includes a color cartridge service station, indicated generally at 18, and a black cartridge service station, indicated generally at 20. Service stations 18, 20 are mounted 180° apart on a rotatable carrier 22 which is rotatable 180° about an axis 24. The carrier rotates responsive to a driven gear (not shown) which engages with a sprocket 26 on carrier 22. If a color cartridge, instead of black cartridge 14, is mounted on carriage 12, carrier 22 rotates 180° so that color station 18 is oriented upwardly with black station 20 assuming the position shown for the color station in FIG. 1. On the other hand, with black cartridge 14 mounted on carriage 12, carrier 22 is in the position illustrated in FIG. 1.

Black station 20 includes a cap system indicated generally at 31. The cap system includes a basin structure 28, a black sled 30 and a black cap 32 all of which are received in a tray 34 formed in carrier 22. A spring 36 biases sled 30, as well as cap 32 and basin structure 28 which are mounted on the sled, to the left as viewed in FIG. 1. Tray 34 includes a pair of opposed cam surfaces, 38, 40 upon which cam followers, like cam followers 42, 44 ride. A post 46 presents a leftward-facing surface which engages with an arm 48 on carriage 12 as the carriage moves to the right. As can be seen in FIG. 1, when carriage 12 moves leftwardly from the service station, spring 36 biases sled 30 to the left. Followers 42, 44 ride surface 40 downwardly thus lowering the sled from the view of FIG. 1. Conversely, as the sled moves toward the service station, arm 48 engages post 46 thus moving sled 30 to the right and upwardly. Such action urges cap 32 against printhead 15.

As the black cartridge moves into the station and prior to printhead 15 being covered by cap 32, printhead 15 traverses the tip of a wiper 50 which wipes ink and debris from the printhead surface. Wiper 50 is mounted on a follower bracket 52. The follower bracket includes a post 54 which is received in an opening 56 formed in wiper 50. A rectangular frame 58 surrounds a cam 60 mounted on carrier 22. A pair of downwardly extending posts 62, 64 are received in a pair of corresponding holes (not shown) contained in printer structure (also not shown) beneath carrier 22 in FIG. 1. It can be seen that bracket 52 is maintained in an upper position by cam 60 when carrier 22 is in the position illustrated in FIG. 1. When the carrier rotates 180°, the bracket moves to a lower position as cam 60 rotates from under the bracket.

Color station 18 includes a color cap system indicated generally at 65. The color cap system includes a color cap 66 and a color sled 68 (which is also referred to herein as a base). A spring 70 biases the sled to the left in FIG. 1. Cap 66 is mounted on sled 68. When a color cartridge (not shown), rather than black cartridge 14, is mounted on carriage 12, carrier 22 is rotated 180° about axis 24 thus directing cap 66 in an upward direction. When carrier 22 so rotates, cam 60 inverts and drives bracket 52 to its lower position. A color wiper 72 which is mounted on carrier 22 is then also directed upwardly.

A cam surface 74 (in FIG. 1), such being similar to surface 40, is formed on carrier 22. Cam followers 76, 78 ride on the surface similar to the manner in which followers 42, 44 ride on surface 40. An arm 80 extends from color sled 68 in the same fashion that arm 46 extends from black sled 30.

With a color cartridge (not shown) mounted on carriage 12 instead of black cartridge 14, movement of color sled 68 relative to carriage 12 is similar to that previously described for black sled 30. As carriage 12 moves to the right toward the position illustrated in FIG. 1, the color printhead is wiped by wipers 72 the tips of which extend above the tips of wiper 50, which is in its lower position. Next, arm 48 on carriage 12 strikes post 80 thereby moving color sled 68 upwardly and to the right. Cap 66 is thus urged against the color printhead.

Attention is now directed to FIGS. 3–6 for a more detailed consideration of the structure comprising cap system 31. Cap 32 is constructed from ethylene propylene diene monomer (EPDM) sold by Monsanto Company, Inc. under the SANTOPRENE trademark. The EPDM from which cap 32 is molded has a durometer of approximately 35 Shore A. Cap 32 includes a sealing lip 82 bordering an opening 84 formed in the cap. The cap is fitted over a raised portion 86 of sled 30. An aperture 88 is formed through raised portion 86 thus permitting communication through opening 84 and aperture 88 to basin 28, best viewed in FIG. 4.

Sled 30 includes a pair of downwardly extending legs 90, 92 which engage with structure on carrier 22 (in FIG. 1), to maintain the sled on the carrier as it moves laterally in tray 34 as previously described. Sled 30 is relatively rigid compared to cap 32 and in the present embodiment of the invention comprises molded nylon. The nylon from which sled 30 is molded is referred to herein as a first material. Sled 30 includes a lug 94 over which one end of spring 36 is received for biasing the sled to the left in tray 34 viewed in FIGS. 1 and 2. The sled includes a substantially planar base 96 which is substantially in the shape of basin structure 28 and which is positioned immediately above the basin structure. Base 96 is referred to herein as a basin cover. The under side of base 96 comprises a substantially planar surface 97. The base is bounded by a downwardly extending wall 98 which extends about the circumference of the base. Thus, as best viewed in FIGS. 5 and 6, when cap system 31 is assembled the upper surface of basin structure 28 is substantially coplanar with surface 97 on the under side of base 96.

Figure 5:
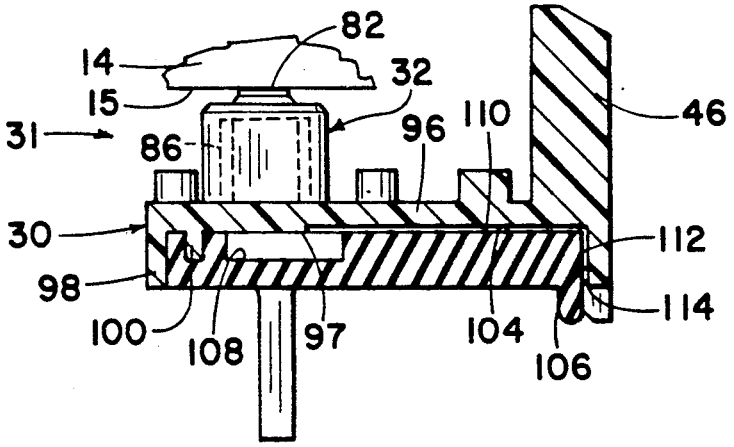
FIG. 5 is a sectional view taken along line 5—5 in FIG. 4.
Figure 6:
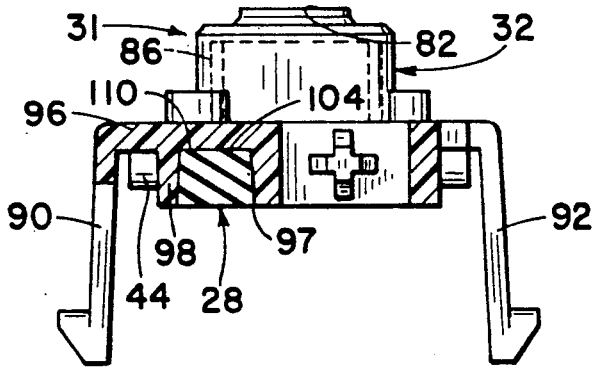
FIG. 6 is a sectional view taken along line 6—6 in FIG. 4.

A downwardly extending ridge 100 (in FIG. 5) is parallel with wall 98. Ridge 100 is formed adjacent three sides of the wall. When the upper surface of basin structure 28 is substantially flushly abutting surface 97 on the under side of the sled, as shown in FIGS. 5 and 6, a channel 102 formed in the upper surface of basin structure 28 is filled by ridge 100. The basin structure is thus secured to the under side of the sled via an interference fit between ridge 100 and channel 102 and between the sides of basin structure 28 and the inner side of wall 98.

A groove 104 is formed in surface 97. A second groove 106 is formed on an inner surface of wall 98 and communicates with groove 104. The sectional view of FIG. 5 is taken through grooves 104, 106.

Basin structure 28 is molded from EPDM. EPDM is referred to herein as a second material and as nonabsorbent wetting material means. As is known by those skilled in the art, whether a surface is wetting affects the capillary action of liquid contained on the surface.

Basin structure 28 includes a substantially planar upper surface 110 in which channel 102 and a basin 108 and are formed. A side surface 112 of basin structure 28 is received adjacent groove 106. A vent is defined between grooves 104, 106 in sled 32 and basin structure surfaces 110, 112. The vent has a first end which communicates with basin 108 and a second end 114 which communicates with the exterior of cap system 31. Grooves 104, 106 define what is referred to herein as a first side of the vent while surfaces 110, 112 define a second side thereof.

Figure 7:
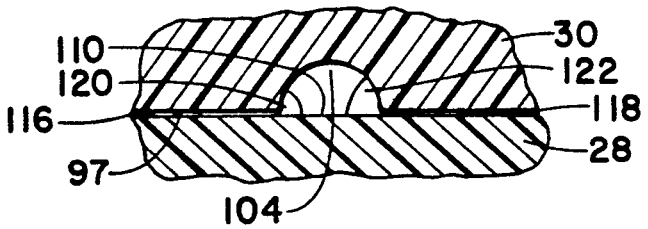
FIG. 7 is an enlarged, partial view of a portion of the cap shown in FIG. 6.

Capillary spaces 116, 118 in FIG. 7 are defined between surface 97 on the under side of sled 32 and surface 110 on the upper side of basin structure 28. Capillary spaces are also formed between the sides of basin structure 28 and the inner side of wall 98. Although the lower surface of the vent is referred to herein as being substantially coplanar with the under side of the basin cover, it is understood that the relatively small capillary space, spaces 116, 118, are defined between surfaces 97, 110.

Ink drops 120, 122 (in FIG. 7) are formed in the vent adjacent the juncture of groove 104 and surface 110.

Considering now the operation of the present embodiment of the invention, when black cartridge 14 is in its associated service station as illustrated in FIGS. 1 and 5, ink may drool from the nozzles (not shown) in cartridge 14. Such ink falls through opening 84 in cap 32 and through aperture 88 in sled 30 into basin 108. When basin 108 becomes filled with ink, ink flows into the vent and out end 114 thereof into an ink drain pan (not shown). Any ink remaining in the vent tends to form drops in the corners of the vent, like drops 120, 122 in FIG. 7 due to capillary action and the force of gravity. Such drops are drawn by capillary action into spaces 116, 118 and from there to the exterior of the cap system via the space between basin structure 28 and sled 30. As cap system 31 covers and uncovers printhead 14 as described above, the vent equalizes the pressure between the interior of the cap system and the exterior thereof thus reducing the tendency of ink in the cartridge nozzles to flow responsive to pressure changes.

Figure 8:
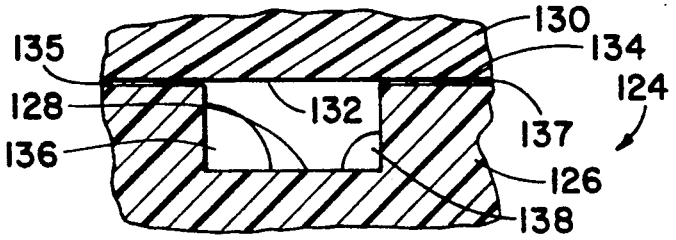
Fig. 8 (PRIOR ART)
FIG. 8 is a view similar to FIG. 7 of a prior art cap.

Considering now FIG. 8, indicated generally at 124 is a prior art vent for a printhead cap. Vent 124 includes an EPDM basin structure 126 having a groove 128 with a rectangular cross section formed therein. A polycarbonate sled 130 includes a substantially planar undersurface 132 which substantially flushly abuts against an upper surface 134 of basin structure 126. Like cap system 31 in FIG. 5, a basin (not shown in FIG. 8) is formed on surface 134 of basin structure 126. Under surface 132 of sled 130 covers the basin formed in structure 126. Capillary spaces 135, 137 are formed between surfaces 132, 134.

In operation, prior art vent 124 in FIG. 8 also drains ink from its associated basin. Ink drops 136, 138 collect in the lower corners of vent 124 where they are unable to flow into capillary spaces 135, 137. Ink in vent 124 is not drawn into capillary spaces 135, 137 until the vent is entirely filled with ink. When ink no longer flows from the basin associated with vent 124 into the vent, ink remains standing in vent 124. Vent 124 is necessarily made much shorter than the vent of the present invention in order to prevent vent clogging. Because the vent of present invention is longer, ink vapor in cap system 31 is less able to diffuse from the vent thus providing a cap system which reduces ink drying in the printhead nozzles.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A cap system for use in an ink-jet printer having a bidirectionally movable print carriage supporting a printhead having ink nozzles thereon, said cap system being fixed along a travel path of the print carriage and comprising:

a cap urgable against the printhead when said carriage is positioned along said travel path so that said carriage is adjacent said cap system;

a chamber defined in said cap;

a cap opening in communication with said chamber, said nozzles being in communication with said opening when said cap is urged against said printhead;

an elongate vent having a substantially horizontal longitudinal axis and further having a first end in communication with said chamber and a second end in communication with an exterior portion of said cap; and a capillary space immediately adjacent a lowest portion of said vent and extending laterally therefrom for drawing liquid from the vent into the capillary space.

2. The cap system of claim 1 wherein said vent has a substantially semicircular cross section.

3. The cap system of claim 2 wherein said vent comprises a first arcuate side and a second substantially planar side and wherein said planar side comprises the lowest portion of said vent.

4. The cap system of claim 3 wherein said capillary space joins said vent between said first and second sides.

5. The cap system of claim 3 wherein said arcuate side is formed from a first material and said substantially planar side is formed from a second material.

6. The cap system of claim 5 wherein said capillary space comprises a space between said first and second materials.

7. The cap system of claim 1 wherein said capillary space extends laterally from said vent between said first vent end and second vent end.

* * * * *